United States Patent [19]

Kaneko

[11] Patent Number: 4,933,997

[45] Date of Patent: Jun. 19, 1990

[54] METHOD OF DRIVING PRIVATE PARTS WASHING DEVICE

[75] Inventor: Kenichi Kaneko, Kariya, Japan

[73] Assignee: Aisin Seiki Kabushiki Kaisha, Aichi, Japan

[21] Appl. No.: 835,922

[22] Filed: Mar. 4, 1986

[30] Foreign Application Priority Data

Mar. 7, 1985 [JP] Japan ..... 60-045636

[51] Int. Cl.[5] ..... A47K 3/20

[52] U.S. Cl. ..... 4/420.4

[58] Field of Search ..... 4/443–448, 4/420.1–420.5; 141/90

[56] References Cited

U.S. PATENT DOCUMENTS

| | | | |
|---|---|---|---|
| 3,524,483 | 8/1970 | Smith | 141/90 |
| 3,552,212 | 1/1971 | Ohlin | 141/90 X |
| 3,850,207 | 11/1974 | Loliger et al. | 141/90 |
| 4,369,820 | 1/1983 | Ahlers et al. | 141/90 X |
| 4,451,942 | 6/1984 | Hirano et al. | 4/420.4 X |
| 4,564,961 | 1/1986 | Kaneko et al. | 4/443 |

FOREIGN PATENT DOCUMENTS 59-15140 1/1984 Japan .

*Primary Examiner*—Charles E. Phillips

*Attorney, Agent, or Firm*—Sughrue, Mion, Zinn, Macpeak & Seas

[57] ABSTRACT

A method of driving a private parts washing device incorporated into a toilet bowl for washing the private parts and equipped with a retractable nozzle capable of being extended to the private parts washing position and retracted within the toilet bowl to the retracted position. Washing water is spouted through the spout of the nozzle with the nozzle retracted within the toilet bowl at least either before or after washing the private parts; nozzle washing water is also supplied while the nozzle is at least either being extended or retracted, to wash the outer circumference of the nozzle; and washing water is spouted through the spout of the nozzle after the nozzle has been fully extended and stopped at the private parts washing position, to wash the private parts.

4 Claims, 7 Drawing Sheets

METHOD OF DRIVING PRIVATE PARTS WASHING DEVICE

BACKGROUND OF THE INVENTION

1. Field of the Invention:

The present invention relates to improvements in a method of driving a private parts washing device incorporated into a toilet bowl.

2. The Prior Art:

Recently, sanitary advantages of the private parts washing device have been appreciated and the private parts washing device has become widely used. A known private parts washing device is equipped with a retractable nozzle through which washing water is spouted against the private parts for washing; and the nozzle of such a private parts washing device needs to be washed after washing the private parts.

Japanese Unexamined Patent Publication (Kokai) No. 59-15140 discloses a method of washing the nozzle head of the nozzle of a private parts washing device by using the water remaining in the nozzle after washing the private parts. By this known method, the retractable nozzle is washed at the retracted position by spouting water through a nozzle hole formed in the nozzle head. Therefore, this method is able to wash only the nozzle head and is scarcely able to wash other portions of the nozzle. Consequently, the nozzle remains insanitary and, sometimes, the nozzle is so fouled that the nozzle becomes unable to be extended or retracted.

SUMMARY OF THE INVENTION

Accordingly, it is an object of the present invention to provide a method of driving a private parts washing device, capable of entirely washing the nozzle of a private parts washing device.

The object of the present invention is achieved by a method of driving a private parts washing device comprising a toilet bowl, a retractable nozzle provided at the extremity thereof with a spout and held so as to be retracted within the toilet bowl, a nozzle washing hole formed in the toilet bowl in order to introduce washing water over the entire outer circumference of the nozzle, a nozzle driving unit for extending and retracting the nozzle, and a washing water supplying unit for supplying washing water to the nozzle and the nozzle washing hole, which comprises: spouting washing water through the spout of the nozzle with the nozzle retracted within the toilet bowl at least either before or after washing the private parts; supplying washing water mainly to the nozzle washing hole from the washing water supplying unit while the nozzle is at least either being extended or retracted by the nozzle driving unit; and supplying washing water from the washing water supplying unit to the spout after the nozzle has been fully extended and stopped.

DISCLOSURE OF THE INVENTION

The constitution of the components of a private parts washing device which is driven by a method according to the present invention will be described hereinafter prior to the description of a preferred embodiment of the present invention.

The private parts washing device employs a conventional retractable nozzle provided at the extremity thereof with a spout for spouting private parts washing water for washing the private parts, such as the anus. The nozzle may be extended or retracted in a single step or in a plurality of steps. The private parts washing device may be provided with either a single nozzle or two nozzles. The nozzle is extended and retracted by a nozzle driving unit. When the nozzle is fully extended, the extremity thereof is located opposite the private parts to wash the private parts. The nozzle can be retracted fully within the toilet bowl so that the nozzle is moved away from the passage of the stool. The nozzle driving unit is the same as the conventional nozzle driving unit including a motor and other parts.

A nozzle receptacle formed in the toilet bowl is provided with a nozzle washing hole for pouring nozzle washing water over the outer circumference of the nozzle to wash the nozzle. A washing water supplying unit supplies the nozzle washing water. The private parts washing water and the nozzle washing water may be supplied from either one source of water or individual sources of water. When individual sources of water are provided, various additives can be added to the nozzle washing water to enhance the washing effect of the nozzle washing water or to make the nozzle move more smoothly. The city water may be supplied as the nozzle washing water directly from the water service line or by means of a pump or like means after temporarily reserving the city water in a reservoir tank.

The washing water supplying unit supplies the washing water to both the spout of the nozzle and the nozzle washing hole and comprises a motor-driven pump, a solenoid controlled valve for opening and closing a line connected to a city water supply line.

It is the most significant feature of the present invention that the washing water supplying unit supplies the washing water selectively to the spout of the nozzle and the nozzle washing hole according to the position of the nozzle. That is, the washing water supplying unit supplies the private parts washing water to the spout of the nozzle to wash the extremity of the nozzle when the nozzle is retracted within the toilet bowl, the nozzle washing water to the nozzle washing hole to wash the other portion of the nozzle when the nozzle is being extended or retracted by the nozzle driving unit, and the private parts washing water to the spout of the nozzle to wash the private parts when the nozzle is fully extended and stopped.

In supplying the nozzle washing water to the nozzle washing hole while the nozzle is being moved, the nozzle washing water may be supplied both while the nozzle is being extended and while the nozzle is being retracted, or either while the nozzle is being extended or while the nozzle is being retracted, however, it is desirable to supply the nozzle washing water to the nozzle washing hole while the nozzle is being retracted after washing the private parts.

In supplying the private parts washing water to the spout of the nozzle with the nozzle located at the retracted position, the private parts washing water may be supplied to the spout of the nozzle either before or after washing the private parts, however, it is desirable to supply the private parts washing water to the spout of the nozzle both before and after washing the private parts. When warm water is used as the private parts washing water, spouting the private parts washing water prior to washing the private parts discharges the cold private parts washing water remaining in the nozzle before washing the private parts and avoids disagreeable washing of the private parts with the cold private parts washing water. Washing the extremity of the nozzle after washing the private parts insures the sanitary conditions of the extremity of the nozzle and prevents the spout of the nozzle from blocking up.

The nozzle driving unit and the washing water supplying unit can be operated sequentially by an ordinary electric circuit, however, it is preferable to employ a digital circuit including a microcomputer for controlling the sequential operation of the nozzle driving unit and the washing water supplying unit.

The above and other objects, features and advantages of the present invention will become more apparent from the following description of the preferred embodiment thereof taken in conjunction with the accompanying drawings.

DESCRIPTION OF THE PREFERRED EMBODIMENT

Figure 5:
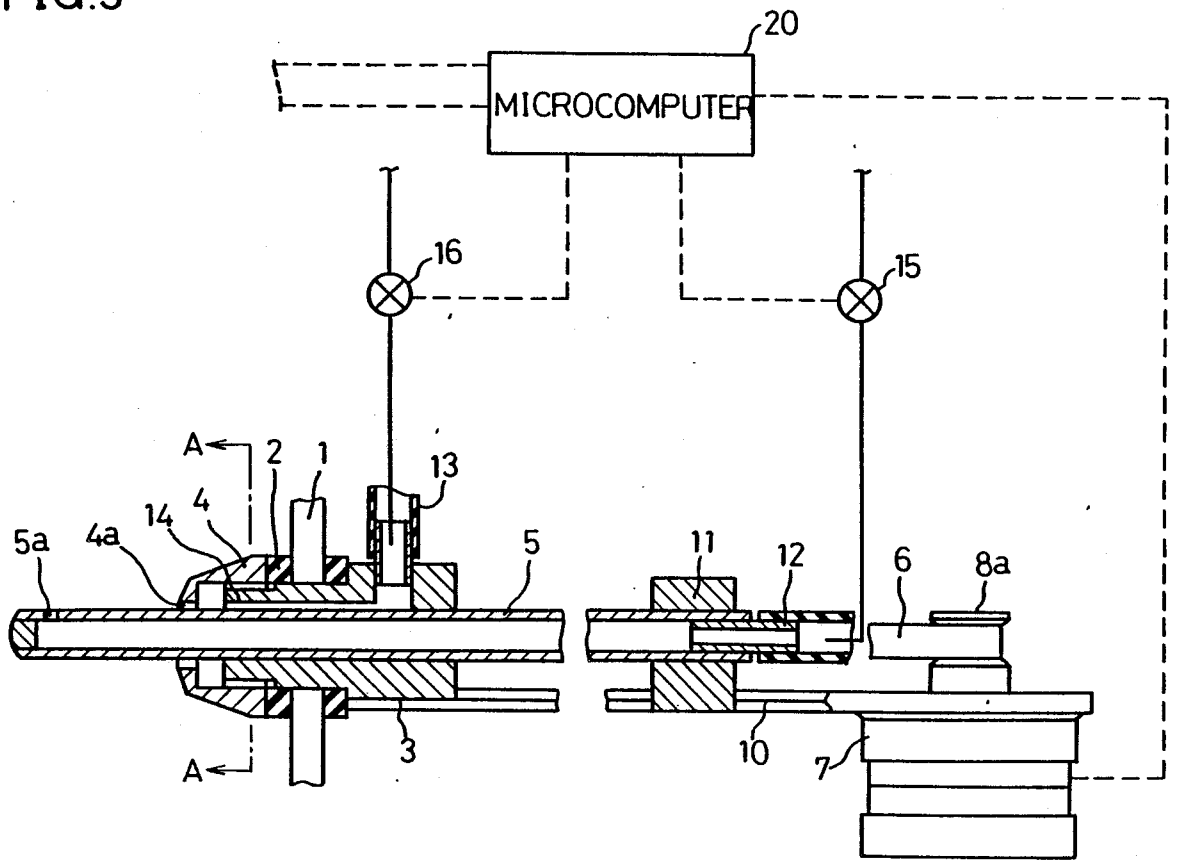
FIG. 5 is a fragmentary sectional view of assistance in explaining a private parts washing apparatus to which the present invention is applied.
Figure 6:
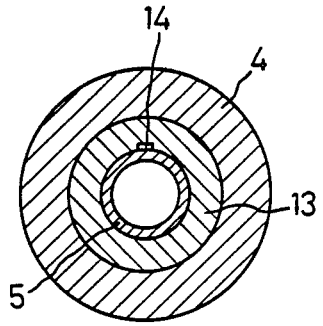
FIG. 6 is a sectional view taken on line A—A in FIG. 5.
Figure 7:
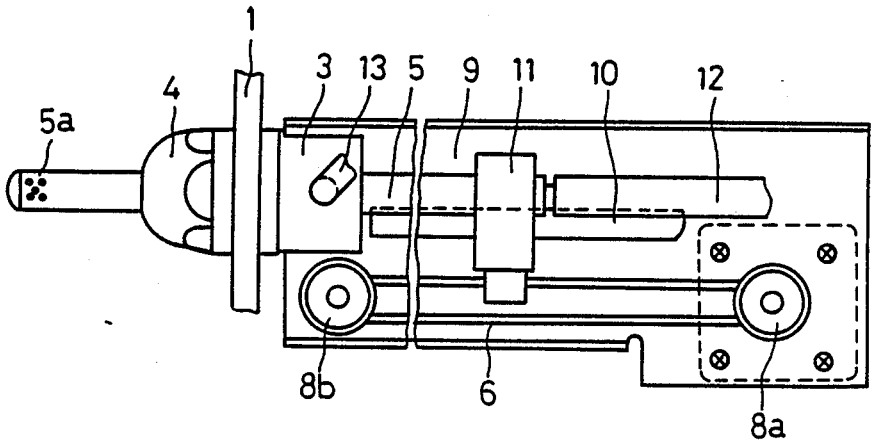
FIG. 7 is a plan view of the nozzle and the associated parts shown in FIG. 5.

FIGS. 5, 6 and 7 illustrate the nozzle and the associated parts of a private parts washing device to which a method of driving a private parts washing device, according to the present invention is applied.

The private parts washing device comprises a nozzle guide 3 fastened through a rubber packing 2 to a toilet bowl 1 with a nut 4, a nozzle 5 provided at the extremity thereof with a spout 5*a* and slidably inserted in the through hole of the nozzle guide 3, and a driving belt for driving the nozzle 5 in the extending direction and the retracting direction. The driving belt 6 is extended between a pulley 8*a* attached to the output shaft of a nozzle driving motor 7 and a pulley 8*b* rotatably supported on a base plate 9. The pulley 8*a* is rotated by the nozzle driving motor 7 in opposite directions to turn the driving belt 6 in opposite directions, respectively. A sliding member 11 capable of sliding along a guide groove 10 formed in the base plate 9 is fixed to the driving belt 6. The rear end of the nozzle 5 is fixedly fitted in a through hole formed in the sliding member 11. Thus, the nozzle 5 is driven through the pulley 8*a*, the driving belt 6 and the sliding member 11 by the nozzle driving motor 7.

A private parts washing water supplying tube 12 for supplying the private parts washing water to the spout 5*a* of the nozzle 5 is connected to the rear end of the nozzle 5. The private parts washing water flows through the nozzle 5 and is spouted through the spout 5*a*.

A nozzle washing water supplying tube 13 for supplying the nozzle washing water is connected to the nozzle guide 3. The nozzle washing water supplied to the nozzle guide 3 flows along an axial washing groove 14 (nozzle washing hole) formed in the inner circumference of the nozzle guide 3 to wash the outer circumference of the nozzle 5. The nozzle washing water supplied into the nozzle guide 3 is discharged through an opening 4*a* formed in the nut 4 into the interior of the toilet bowl 1.

The washing water is supplied through a private parts washing water supply valve 15 and a nozzle washing water supply valve 16 to the private parts washing water supplying tube 12 and the nozzle washing water supplying tube 13, respectively, from a reservoir tank, not shown, by means of a motor-driven pump, not shown. A microcomputer 20 controls the operation of the valves 15 and 16 and the nozzle driving motor 7.

Figure 2:
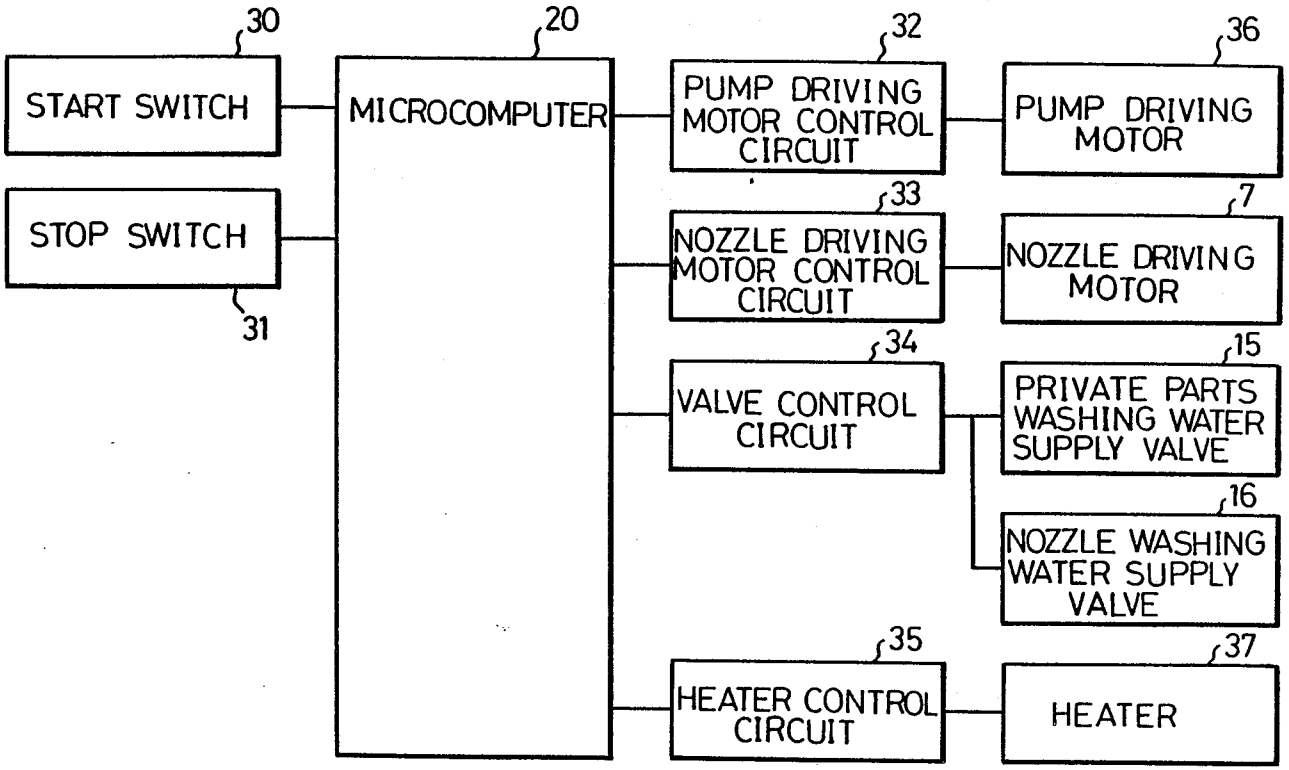
FIG. 2 is a block diagram of an electric circuit employed in a private parts washing device to which the present invention is applied.
Figures 3, 4:
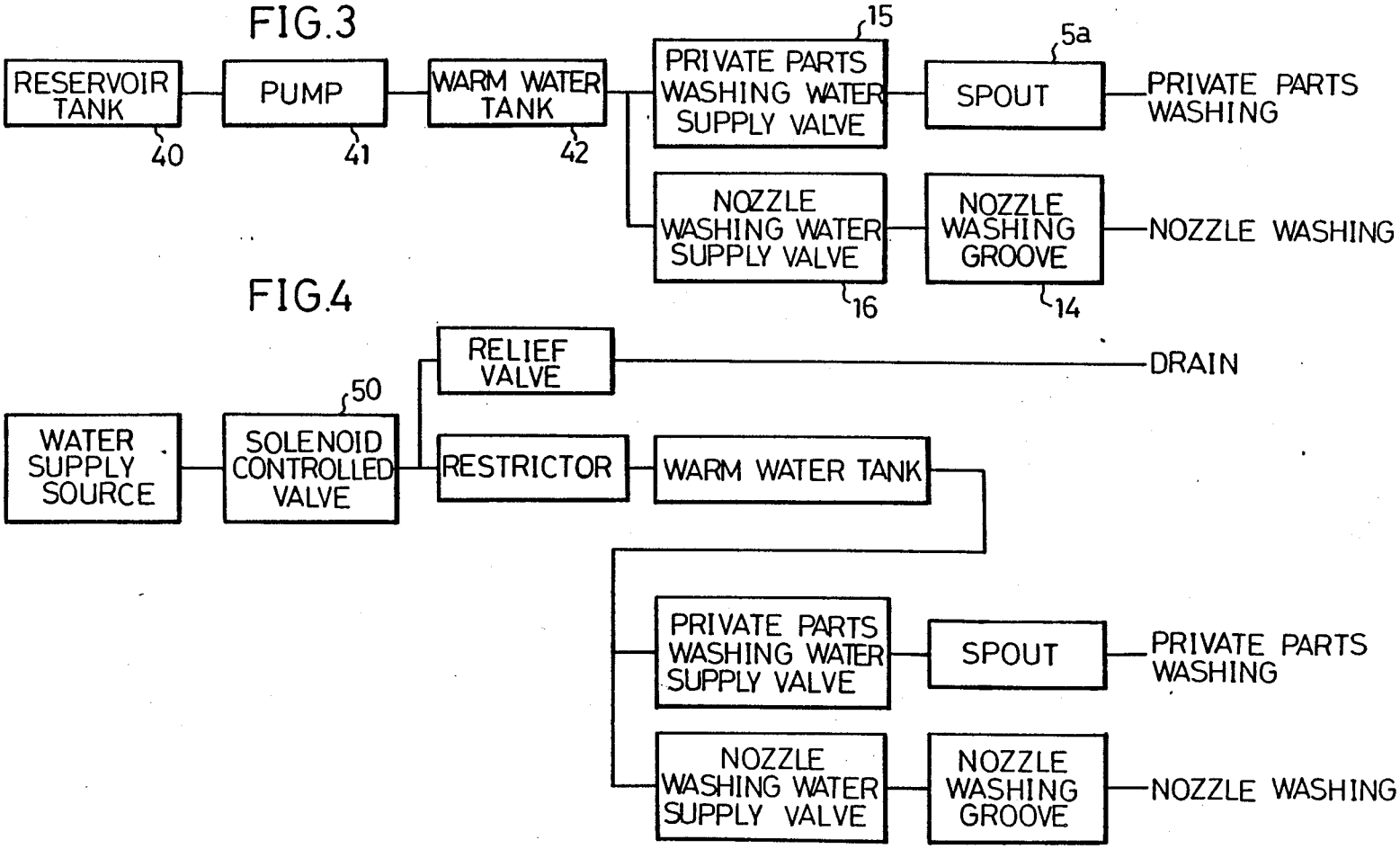
FIG. 3 is a block diagram of a washing water supplying unit employed in a private parts washing device to which the present invention is applied.
FIG. 4 is a block diagram of another washing water supplying unit applicable to a private parts washing device to which the present invention is applied.

Referring to FIG. 2, the microcomputer receives the input signals of a start switch 30 and a stop switch 31 and gives output signals to a pump driving motor control circuit 32. The pump driving motor control circuit 32 actuates or stops a pump driving motor 36 according to a signal given thereto by the microcomputer 20. The microcomputer 20 gives a signal to a nozzle driving motor control circuit 33 to actuate the nozzle driving motor 7 when the pump driving motor 36 is actuated and also gives a signal to a valve control circuit 34 to open the private parts washing water supply valve 15 or the nozzle washing water supply valve 16 depending on the position of the nozzle 5. As illustrated in FIG. 3, a warm water tank 42 is provided in the washing water supply line. The warm water tank is provided with a heater 37 for heating the washing water. The microcomputer 20 gives a signal to a heater control circuit 35 so that the washing water contained in the warm water tank 42 is always heated at a fixed temperature.

Referring to FIG. 3 showing a washing water supply unit in a block diagram, the water reserved in the reservoir tank 40 is supplied through the warm water tank 42 by means of a pump 41. The warm washing water heated in the warm water tank 42 is distributed through the valves 15 and 16 to the spout 5*a* and the washing groove 14 for washing the private parts and the nozzle 5, respectively. In this embodiment, the washing water is supplied from the reservoir 40, however, it is also possible to supply the city water directly by a washing water supply unit illustrated in FIG. 4. In directly supplying the city water to the nozzle 5 and the washing groove 14, a solenoid controlled valve 50, for instance, is used instead of the pump 41.

Figure 1:
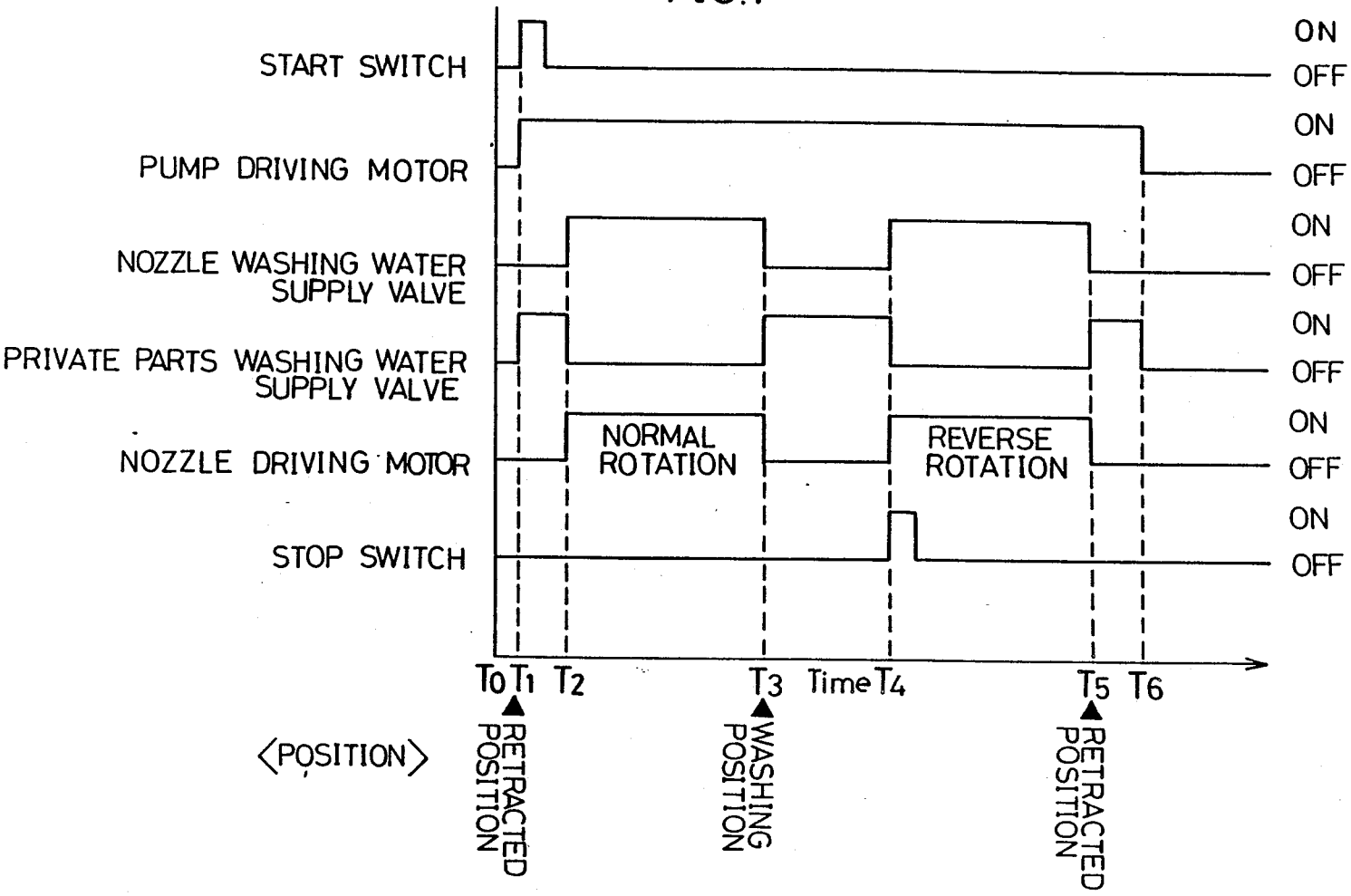
FIG. 1 is a time chart showing the sequential operation of the components of a private parts washing device to which the method of driving a private parts washing device, according to the present invention is applied.

FIG. 1 is a time chart showing the sequential operation of the components of the private parts washing device under the control of a method according to this embodiment of the present invention.

At a time $T_0$, all the components are stopped. At a time $T_1$, the start switch 30 is operated, and thereby the pump driving motor 36 is actuated to supply the washing water and, at the same time, the private parts washing water supply valve 15 is opened to spout the private parts washing water through the spout 5*a* of the nozzle 5 from the time $T_1$ to a time $T_2$ to wash the extremity of the nozzle 5. The private parts washing water spouted through the spout 5*a* of the nozzle 5 in this state is reflected by the inner surface of the nut 4 to wash the extremity of the nozzle 5.

The private parts washing water supply valve 15 is closed and the nozzle driving motor 7 starts rotating in the normal direction to extend the nozzle 5 at the time $T_2$. At the same time, the nozzle washing water supply valve 16 is opened to supply the nozzle washing water into the washing groove 14, whereby the outer circumference of the nozzle 5 is washed as the nozzle 5 is extended.

At a time $T_3$, the nozzle driving motor 7 is stopped to stop the nozzle 5 at the private parts washing position, the nozzle washing water supply valve 16 is closed and the private parts washing water supply valve 15 is opened to supply the private parts washing water to the spout 5*a* of the nozzle 5. This state is maintained to wash the private parts until the stop switch 31 is operated at a time $T_4$.

Upon the operation of the stop switch 31 at the time $T_4$, the nozzle driving motor 7 is reversed to start retracting the nozzle 5, the private parts washing water supply valve 15 is closed and the nozzle washing water supply valve 16 is opened to wash the outer circumference of the nozzle 5 while the nozzle 5 is being retracted.

At a time $T_5$, the nozzle driving motor 7 is stopped to stop the nozzle 5 at the retracted position, and then the nozzle washing water supply valve 16 is closed and the private parts washing water supply valve 15 is opened, and thereby the private parts washing water is spouted through the spout 5*a* to wash the extremity of the nozzle 5 until a time $T_6$.

At the time $T_6$, the private parts washing water supply valve 15 is closed and the pump driving motor 36 is stopped to complete one operating cycle of the private parts washing device.

Figure 8:
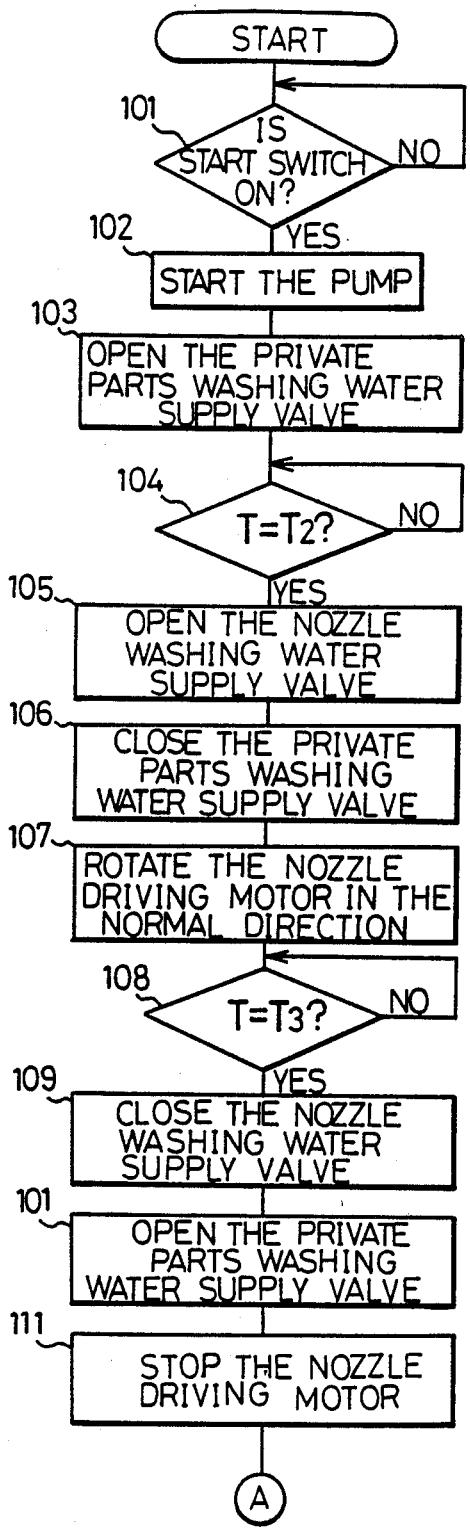
FIGS. 8 and 9 are flow charts of a control program of a computer for carrying out the method according to the present invention.
Figure 9:
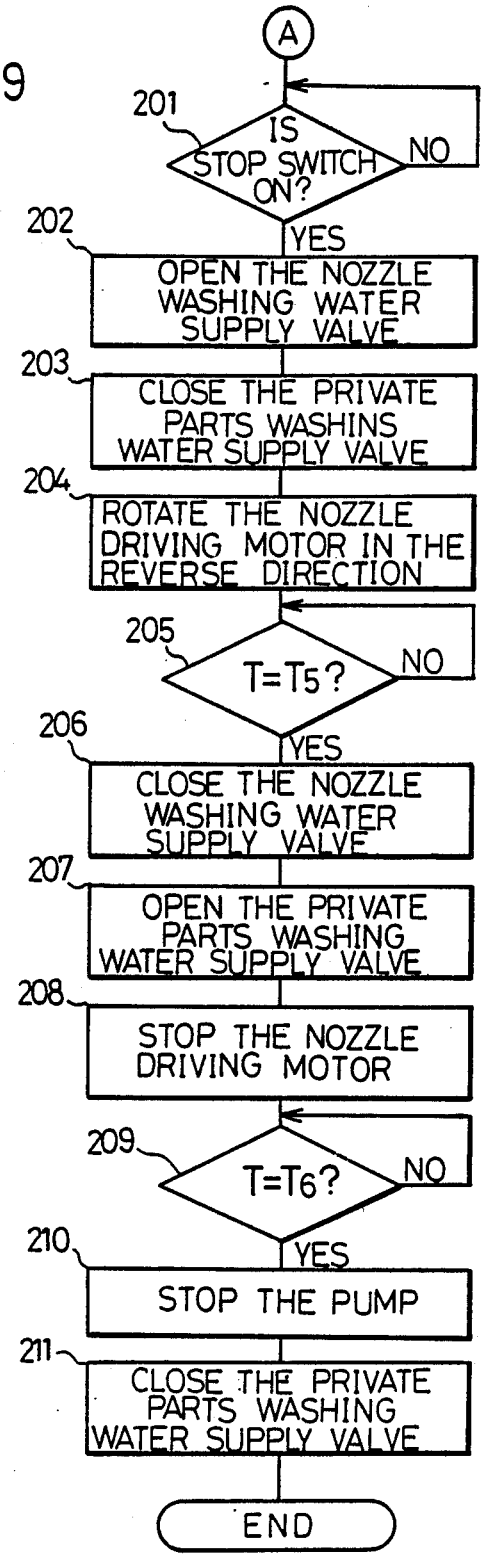

FIGS. 8 and 9 are flow charts of a control program of the microcomputer 20 for sequentially controlling the components of the private parts washing device by the method according to the present invention in the manner represented by the time chart of FIG. 1.

Referring to FIGS. 8 and 9, when a decision that the start switch 30 is operated is made at Step 101, the pump driving motor 36 is actuated at Step 102 and the private parts washing water supply valve 15 is opened at Step 103. This state is maintained until the time $T_2$. When a decision that the time T is the time $T_2$ is made at Step 104, the nozzle washing water supply valve 16 is opened at Step 105, the private parts washing water supply valve 15 is closed at Step 106, and the nozzle driving motor 7 is actuated so as to rotate in the normal direction at Step 107. This state is maintained until the time $T_3$ when the nozzle 5 is fully extended to the private parts washing position, and thereby the outer circumference of the nozzle 5 is washed as the nozzle is extended. When a decision that the time T is the time $T_3$ is made at Step 108, the nozzle washing water supply valve 16 is closed at Step 109, the private parts washing water supply valve 15 is opened at Step 110, and the nozzle driving motor 7 is stopped at Step 111 to wash the private parts.

When a decision that the stop switch 31 is operated is made at Step 201, the nozzle washing water supply valve 16 is opened at Step 202, the private parts washing water supply valve 15 is closed at Step 203, and the nozzle driving motor 7 is reversed at Step 204. This state is maintained until the time $T_5$ when the nozzle 5 is retracted to the retracted position, and thereby the outer circumference of the nozzle is washed as the nozzle is retracted. When a decision that the time T is the time $T_5$, namely, that the nozzle has been retracted to the retracted position, is made at Step 205, the nozzle washing water supply valve 16 is closed at Step 206, the private parts washing water supply valve 15 is opened at Step 207, and the nozzle driving motor 7 is stopped at Step 208, and thereby the extremity of the nozzle 5 is washed until the time $T_6$. When a decision that the time T is the time $T_6$ is made at Step 209, the pump driving motor 36 is stopped at Step 210, and the private parts washing water supply valve 15 is closed at Step 211 to complete one operating cycle of the private parts washing device.

In the above-mentioned method of driving a private parts washing device, embodying the present invention, the nozzle washing water is supplied to the washing groove while the nozzle is being extended and while the nozzle is being retracted; and the extremity of the nozzle is washed with the nozzle positioned at the retracted position by spouting the private parts washing water through the spout of the nozzle before and after washing the private parts. Accordingly, the extremity of the nozzle is always kept in a sanitary condition. Furthermore, spouting the washing water through the spout of the nozzle before washing the private parts cleans the extremity of the nozzle and discharges cold private parts washing water remaining within the nozzle before washing the private parts, and hence the warm private parts washing water is spouted from the start of spouting the private parts washing water for washing the private parts, which is preferable from the viewpoint of both sanitation and agreeable private parts washing.

The method of driving a private parts washing apparatus, according to the present invention is capable of substantially entirely washing the nozzle for desirable sanitation and also for ensuring the smooth movement of the nozzle in extending and retracting the nozzle.

Although the invention has been described in its preferred form with a certain degree of particularity, it is to be understood that many charges and variations are possible in the invention without departing from the scope and spirit thereof.

What is claimed is:

1. A method of driving a private parts washing device comprising a toilet bowl, a nozzle guide supported by the toilet bowl, a retractable nozzle provided at the extremity thereof with a spout and slidably inserted in a through-hole of the nozzle guide, a nozzle washing hole formed in the nozzle guide to introduce washing water over the outer circumference of said nozzle, a nozzle driving unit for extending and retracting said nozzle, and a washing water supplying unit for supplying washing water selectively to said spout of said nozzle and said nozzle washing hole according to the position of the nozzle, which comprises the steps of:

spouting washing water through said spout of said nozzle to wash an inner portion of said nozzle with said nozzle retracted within said toilet bowl at least either before or after washing the private parts;

supplying washing water mainly to said nozzle washing hole from said washing water supplying unit to wash an outer portion of said nozzle while said nozzle is at least either being extended or retracted by said nozzle driving unit; and supplying washing water from said washing water supplying unit to said spout after said nozzle has been fully extended and stopped.

2. A method of driving a private parts washing device, according to claim 1, wherein the washing water is supplied to the nozzle washing hole while the nozzle is being retracted.

3. A method of driving a private parts washing device, according to claim 1, wherein the washing water is spouted through the spout of the nozzle with the nozzle retracted at the retracted position both before and after washing the private parts.

4. A method of driving a private parts washing device, according to claim 3, wherein the washing water is supplied to said nozzle washing hole while the nozzle is being extended and retracted by said nozzle driving unit.

* * * * *